United States Patent [19]

Duncan

[11] 4,062,085

[45] Dec. 13, 1977

[54] SUCTION CLEANING APPARATUS

[75] Inventor: Ian James Duncan, Ely, England

[73] Assignee: Melford Engineering Limited, Ely, England

[21] Appl. No.: 619,509

[22] Filed: Oct. 3, 1975

[51] Int. Cl.[2] ..... A47L 11/29; E01H 1/08

[52] U.S. Cl. ..... 15/339; 15/340; 15/353; 55/228

[58] Field of Search ..... 15/340, 353, 347, 339; 55/228, 257 MD, 259

[56] References Cited

U.S. PATENT DOCUMENTS

| | | | |
|---|---|---|---|
| 1,363,859 | 12/1920 | Fetters et al. | 15/353 X |
| 2,913,744 | 11/1959 | Gregersen | 15/340 X |
| 3,172,143 | 3/1965 | Yucis et al. | 15/353 X |
| 3,447,188 | 6/1969 | Maasberg | 15/340 X |
| 3,817,713 | 6/1974 | Ionescu | 55/228 X |

FOREIGN PATENT DOCUMENTS

| | | | |
|---|---|---|---|
| 1,211,732 | 10/1959 | France | 15/340 |
| 1,217,424 | 5/1966 | Germany | 15/340 |
| 1,059,940 | 2/1967 | United Kingdom | 15/340 |

*Primary Examiner*—Christopher K. Moore
*Attorney, Agent, or Firm*—Watson, Cole, Grindle & Watson

[57] ABSTRACT

Suction cleaning apparatus such as a road cleaning machine comprises a closed chamber for receiving dust and similar matter together with liquid such as water intermingled therewith, the chamber having a suction duct thereto for taking up dust and similar matter from a road or like surface due to suction in the duct created by suction means such as a centrifugal fan communicating with the duct and chamber, return flow means or pipework being provided for passing water from the chamber to the suction duct for intermingling with dust or similar matter drawn into the duct. On discharge of the water laden with dust and similar matter from the duct into the chamber the laden water separates by reduction in velocity from the suction air flow while the water draining from dust and similar matter deposited in the chamber is re-circulated by the return flow means to the suction duct.

10 Claims, 2 Drawing Figures

SUCTION CLEANING APPARATUS

The object of this invention is to provide simple and effective suction cleaning apparatus for taking up dust and similar matter from a surface and has particular, but not exclusive, practical application as a mobile machine for cleaning roads or similar surfaces including factory floors and the like. Practical advantages of the invention will be apparent from the following disclosure.

The terms "dust" or "dust and similar matter" used herein include such waste or unwanted matter as small rubbish, leaves, litter or the like i.e. as taken up by a cleaning or sweeping machine.

In practice and as a road or like cleaning machine, the construction and arrangement is as follows, reference being had to the accompanying diagrammatic drawings in which.

Figure 1:
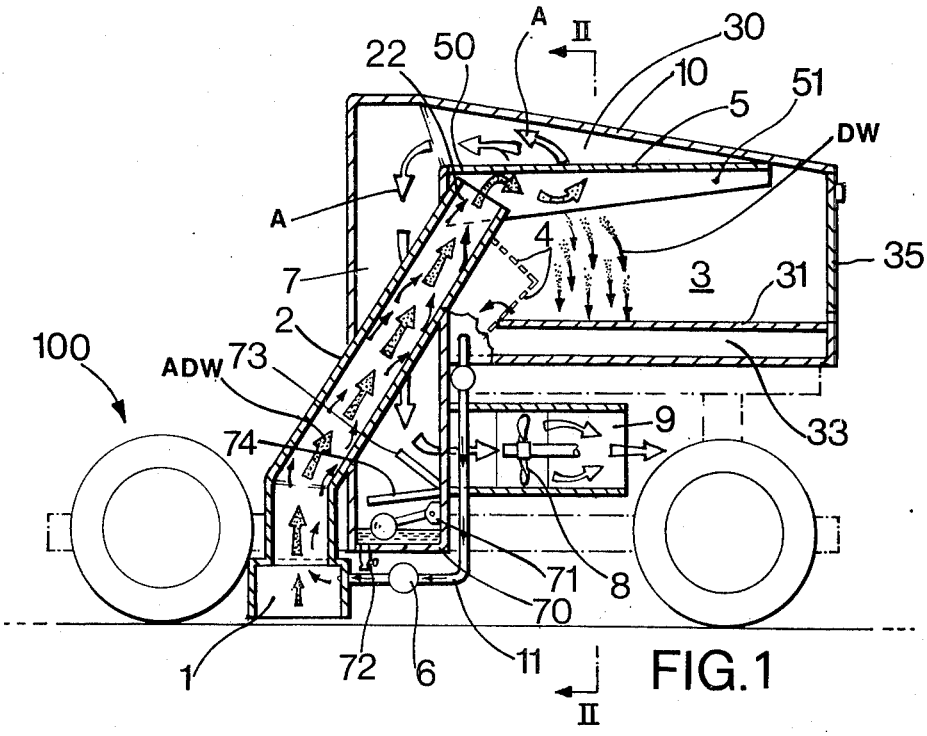
FIG. 1 is a sectional side elevation.
Figure 2:
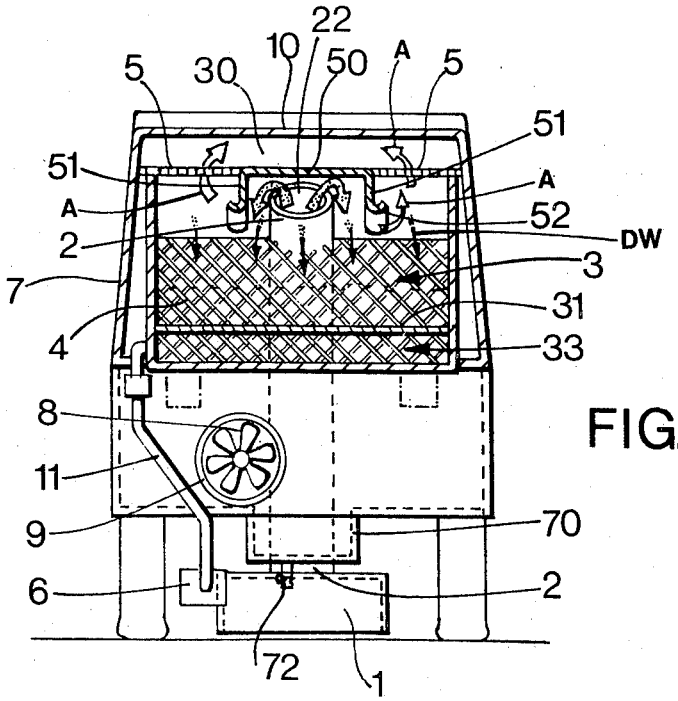
FIG. 2 is a cross section taken on the line II—II of FIG. 1.

As a mobile machine the apparatus is shown carried by a wheeled motor chassis indicated schematically at 100.

An inlet nozzle or head 1 for picking up dust and similar matter is positioned at a lower forward part of the machine and at the lower end of an upwardly extending suction duct 2 which is shown rearwardly inclined whereby its upper outlet end 22 is located in the forward upper part of a closed collecting chamber 3. The inlet head 1 need not necessarily be situated at a forward part of the machine but may be otherwise positioned for close proximity to a road or similar surface.

An enclosed space 30 above the chamber 3 and under a top cover 10 communicates with the upper end of upright large bore passageway trunking 7 which in turn communicates at its lower part with an extractor fan 8 such as a turbo fan, air from the latter passing rearwardly to an exhaust outlet 9.

Filtered water from the chamber 3 passes via return flow pipework 11 to the pick-up nozzle 1 and whereas the return of water to the latter may be by gravity, a pump is shown provided in the pipework at 6. The chamber 3 is shown provided with a filter screen 4 for preventing or minimising collected leaves or like matter from blocking the outlet or outlets from the chamber 3 to the pipework 11. Further filtration of the water passing to the pipework 11 may be provided as necessary.

On operation of the fan 8 suction is created in the duct 2 as indicated by the arrows A and ADW and this causes dust and similar matter to be drawn via the nozzle 1 into the suction duct 2 along with water fed to the nozzle 1 from the chamber 3.

As the dust laden air and water intermingled therewith passes up the suction duct 2 (as indicated by the arrows ADW), the dust and the like is taken up by the water and on discharge of the air and dust bearing water from the upper end of the duct 2, the reduction in velocity of the air and dust bearing water entrained therewith results in separation at DW of the dust-bearing water from the air which latter passes at A in a substantially clean condition via the space 30 and upright passageway 7 to exhaust 9 via the fan 8.

Such separation is further assisted by the provision of a deflector plate 50 shown incorporated in a perforated or mesh screen 5 across the top of the chamber 3 which deflector plate 50 is positioned immediately over the upper outlet end 22 of the duct 2.

The sides of the deflector plate 50 are shown provided with depending side walls 51 to further assist separation of the air from the dust laden water which side walls also have outwardly directed and upturned edges 52 for this purpose. The walls 51 are further shown of diminishing depth in the rearward direction.

In addition to intermingling with the dust and similar matter, the water passing up the duct 2 has a lubricating action in assisting movement of the matter up the duct. It also maintains the interior wall of the duct 2 in a clean condition and minimises wear due to abrasion of the dust or the like having regard to the velocity of the latter up the duct and which may be of the order of 500 feet per second (150 meters per second). Similarly the water flow cleans the deflector plate 50 and protects it against wear.

The chamber 3 carries a sufficient quantity of water (e.g. 40 gallons (180 liters) for operation of the machine over a reasonable period and the re-circulation of the water to the pick-up nozzle 1 and back to the chamber 3 results in continuous use of a substantially constant volume of water (apart from gradual working loss).

Water laden with dust and similar matter discharged into the chamber 3 drains and filters from the dust or the like to the bottom of the chamber 3 where it passes to the pipework 11 for re-circulation. To facilitate this the chamber 3 is shown provided with a raised floor 31 which provides a water compartment 33 at the lower part of the chamber 3 under the floor 31. Instead of a compartment a separate drainage tank may be employed under or below the chamber 3.

After a suitable period of cleaning operation of the machine, collected dust and similar matter is emptied from the chamber 3 on opening a watertight rear closure or door at 35, i.e. to that part of the chamber 3 above the raised floor 31. This enables water to remain in the compartment 33 for further use. However, if necessary the water can be drained off and replaced with a fresh supply.

Whereas water would normally be used other liquid can be employed where appropriate.

Any residual water passing with the air at A into the passageway 7 is separated by inertia owing to the reduced air velocity and runs down the walls of the trunking. When the chamber 3 is full or overfull of dust and similar matter excess water tends to pass into the passageway 7 where it accumulates in a trap 70 at the bottom of the latter in order to actuate a float operated switch 71 which in turn operates a warning device such as a horn and/or lamp to draw attention to the fact that the chamber 3 requires emptying. The trap 70 has a drain cock 72 while an air guidance deflector is shown at 73 in the passageway 7 adjacent the inlet to the extractor fan 8 and also a water baffle 74 over the trap 70.

If desired separator means such as a centrifugal separator may be provided in the passageway 7 but should not be necessary in a road or like cleaning machine.

From the foregoing it will be appreciated that suction cleaning apparatus according to this invention is of extremely simple construction and arrangement and enables a compact high capacity machine to be provided. Furthermore, the arrangement whereby a substantially constant volume of water is continuously used, is convenient and economic in practice and avoids or greatly minimises the need for carrying additional water on the vehicle in one or more storage tanks. However a tank for supplying water to one or more sprinklers may be provided for use when it is necessary to lay fine dry dust.

I claim:

1. Suction cleaning apparatus comprising a closed chamber for receiving dust and similar matter together with liquid such as water intermingled therewith;

a suction duct having an outlet end communicating with the chamber and having an inlet end arranged to be positioned in close proximity with a surface to be cleaned in order to take up dust and similar matter therefrom;

filter means in the chamber for separating liquid from dust and similar matter;

suction means in communication with the chamber for drawing air therefrom thereby creating suction in said duct;

passageway means communicating between the suction means and the chamber, the suction means communicating with the passageway means at substantially a right angle and the passageway means being downwardly directed from the chamber and of large bore for effecting separation by inertia of any residual liquid from the air as the latter is drawn by the suction means via the passageway means from the chamber;

a trap located at a lower part of the passageway means, the trap for receiving an residual liquid separated from air drawn down the passageway means and containing float operated means for effecting indication of an excess quantity of residual liquid drawn with the air into the passageway means and hence an indication that the chamber may be full of dust and similar matter; and, and return flow means for passing liquid from the chamber after separation by the filter means into the suction duct in order to introduce liquid therein essentially for the purpose of intermingling with dust and similar matter drawn by suction into the duct whereby on discharge from the outlet end of the duct into the chamber the liquid laden with dust and similar matter separates by reduction in velocity from the air, the air passing to the suction means while the liquid intermingled with dust and similar matter remains in the chamber.

2. Suction cleaning apparatus according to claim 1 wherein a deflector member such as a plate is positioned adjacent the outlet end of the suction duct in order to direct liquid laden with dust and similar matter into the chamber as it discharges from the outlet end of the suction duct and also assist separation of the laden liquid from the air on the reduction in velocity of the laden liquid to the air.

3. Suction cleaning apparatus according to claim 1 wherein a separate receptacle is provided in the chamber for receiving liquid separated from dust and similar matter in the chamber prior to passage of the liquid by the return flow means for re-circulation to the suction duct.

4. Suction cleaning apparatus comprising a closed chamber for receiving dust and similar matter together with liquid such as water intermingled therewith and having an outlet at its upper part for suction air flow therefrom;

an upwardly directed suction duct having an upper outlet end communicating with an upper part of the chamber below the suction flow outlet of the latter, said suction duct having a lower inlet end arranged to be positioned in close proximity with a surface to be cleaned in order to take up by suction dust and similar matter therefrom;

suction means in communication with the suction flow outlet of the chamber for drawing air therefrom in order to create suction air flow in the chamber and hence in the suction duct;

return flow means for passing liquid from a lower outlet of the chamber and introducing it directly into the interior of said lower inlet end portion of the suction duct solely for the purpose of intermingling the liquid with dust and similar matter drawn by suction into the duct;

a filter screen disposed adjacent to the lower outlet of the chamber and arranged between the chamber interior and the lower outlet and acting to filter liquid passing from the lower outlet so as to separate dust and similar matter therefrom; and, a substantially horizontal deflector plate mounted in the chamber below the suction flow outlet thereof but over the upper outlet end of the suction duct and extending over a substantial part of the lower interior of the chamber in order to deflect liquid laden with dust and similar matter into the chamber as said laden liquid entrained with the suction air flow discharges from the upper outlet end of the suction duct and also to assist separation of the laden liquid from the air on reduction in velocity of the laden liquid and suction air flow, the separated air flow then passing from under the deflector plate to the suction flow outlet of the chamber and thence to the suction means.

5. Suction cleaning apparatus according to claim 4, wherein the deflector plate has depending side walls which diminish in depth in a direction away from the upper outlet end of the suction duct.

6. Suction cleaning apparatus according to claim 4, wherein a separate lower receptacle is provided to the chamber for receiving liquid draining through the filter screen from dust and similar matter in the chamber prior to passage of the liquid by the return flow means for recirculation to the suction duct.

7. Suction cleaning apparatus according to claim 6, wherein the separate receptacle consists of a compartment at the lower part of the chamber and under a raised floor in the latter whereby liquid can drain through the filter screen into the compartment from dust and similar matter supported in the chamber by the raised floor.

8. Suction cleaning apparatus according to claim 6, wherein that part of the chamber above the separate lower receptacle is provided with a watertight closure which can be opened for removal of collected dust and similar matter in the chamber and whereby liquid can remain in the separate lower receptacle for further recirculatory use in the apparatus.

9. Suction cleaning apparatus comprising a closed chamber for receiving dust and similar matter together with liquid such as water intermingled therewith and having an outlet at its upper part for suction air flow therefrom and a lower outlet for liquid flow therefrom;

a filter screen adjacent to the lower outlet of said chamber for filtering liquid from dust and similar matter in the chamber;

an upwardly directed suction duct having an upper outlet end communicating with an upper part of the chamber below the suction flow outlet of the latter, said suction duct having a lower inlet end arranged to be positioned in close proximity with a surface to be cleaned in order to take up by suction dust and similar matter therefrom;

suction means in communication with the suction flow outlet of the chamber for drawing air therefrom in order to create suction air flow in the chamber and hence in the suction duct;

passageway means downwardly directed from the chamber providing communication between the suction means and the suction flow outlet of the chamber the suction means communicating with the passageway means at substantially a right angle and the passageway means being of large bore for effecting separation by inertia of any residual liquid from the suction air flow, as the air is drawn by the suction means via said passageway means from the chamber;

return flow means for passing liquid draining through the filter screen from dust and similar matter in the chamber to a lower interior part of the suction duct in order to introduce liquid therein solely for the purpose of intermingling with dust and similar matter drawn by suction into the duct; and, a substantially horizontal deflector plate mounted in the chamber below the suction flow outlet thereof but over the upper outlet end of the suction duct and extending over a substantial part of the lower interior of the chamber in order to deflect liquid laden with dust and similar matter into the chamber as said laden liquid entrained with the suction air flow discharges from the upper outlet end of the suction duct and also to assist separation of the laden liquid from the air on reduction in velocity of the laden liquid and suction air flow, the separated air flow then passing from under the deflector plate to the suction flow outlet of the chamber and thence to the suction means.

10. Suction cleaning apparatus according to claim 9, wherein a lower part of the downwardly directed passageway means is provided with a trap for receiving any residual liquid separated from suction air flow drawn down the passageway means, said trap containing float operated means for effecting indication of an excess quantity of residual liquid drawn with the suction air flow into the passageway means and hence the fact that the chamber may be substantially full of dust or similar matter.

* * * * *

UNITED STATES PATENT OFFICE
CERTIFICATE OF CORRECTION

PATENT NO. : 4,062,085
DATED : December 13, 1977
INVENTOR(S) : Ian James Duncan

It is certified that error appears in the above-identified patent and that said Letters Patent are hereby corrected as shown below:

To the title page add:

[30] Foreign Application Priority Data

October 9, 1974 Great Britain.....43704/74

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*